US007671523B2

(12) United States Patent
Caplan et al.

(10) Patent No.: US 7,671,523 B2
(45) Date of Patent: Mar. 2, 2010

(54) MATERIAL FOR ELECTRODES OF LOW TEMPERATURE PLASMA GENERATORS

(75) Inventors: Malcolm Caplan, Fremont, CA (US); Sergel Evge'evich Vinogradov, St. Peterburg (RU); Valeri Vasil'evich Ribin, St. Peterburg (RU); Valentin Ivanovich Shekalov, St. Peterburg (RU); Philip Grigor'evich Rutberg, St. Peterburg (RU); Alexi Anatol'evich Safronov, St. Peterburg (RU); Vasili Nikolaevich Shiryaev, St. Peterburg (RU)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 10/445,177

(22) Filed: May 23, 2003

(65) Prior Publication Data

US 2010/0007262 A1 Jan. 14, 2010

(51) Int. Cl.
*H01J 1/28* (2006.01)
*H01K 1/04* (2006.01)

(52) U.S. Cl. ..... 313/346 R; 313/346 DC

(58) Field of Classification Search ..... 313/231.01–231.71, 29, 30, 32, 491, 503, 313/566, 574, 618, 633, 339, 356, 311, 346 R, 313/346 DC, 346; 373/18–25; 118/723; 315/111.21, 111.81, 111.71, 111.31; 445/50, 445/51

See application file for complete search history.

(56) References Cited

U.S. PATENT DOCUMENTS 3,138,453 A * 6/1964 Foster et al. ..... 75/10.65
3,918,957 A * 11/1975 Suzuki et al. ..... 75/10.25
3,953,705 A * 4/1976 Painter ..... 219/121.36
4,168,565 A 9/1979 Ishii et al. ..... 445/51
4,229,873 A 10/1980 Bykhovsky et al. ..... 419/28
4,420,346 A * 12/1983 Belkin et al. ..... 148/512
5,075,589 A * 12/1991 Derks et al. ..... 313/346 DC
5,126,622 A 6/1992 Jeong et al. ..... 313/346 DC
5,128,584 A 7/1992 Choi ..... 313/346 DC
5,200,594 A * 4/1993 Okada et al. ..... 219/121.52
5,318,468 A 6/1994 Lotthammer et al. ..... 445/50

(Continued)

FOREIGN PATENT DOCUMENTS

EP 0537495 A1 4/1993

(Continued)

*Primary Examiner*—Karabi Guharay
(74) *Attorney, Agent, or Firm*—Alan H. Thompson; John H. Lee

(57) ABSTRACT

Material for electrodes of low temperature plasma generators. The material contains a porous metal matrix impregnated with a material emitting electrons. The material uses a mixture of copper and iron powders as a porous metal matrix and a Group IIIB metal component such as $Y_2O_3$ is used as a material emitting electrons at, for example, the proportion of the components, mass %: iron:3-30; $Y_2O_3$:0.05-1; copper: the remainder. Copper provides a high level of heat conduction and electric conductance, iron decreases intensity of copper evaporation in the process of plasma creation providing increased strength and lifetime, $Y_2O_3$ provides decreasing of electronic work function and stability of arc burning. The material can be used for producing the electrodes of low temperature AC plasma generators used for destruction of liquid organic wastes, medical wastes, municipal wastes as well as for decontamination of low level radioactive waste, the destruction of chemical weapons, warfare toxic agents, etc.

18 Claims, 1 Drawing Sheet

U.S. PATENT DOCUMENTS 5,507,675 A 4/1996 Frost ..... 445/50
5,609,777 A 3/1997 Apunevich et al. ..... 219/121.48
5,800,618 A * 9/1998 Niori et al. ..... 118/723 E
5,904,828 A * 5/1999 Sekhar et al. ..... 205/188
2002/0057043 A1 * 5/2002 Miyamoto ..... 313/46

FOREIGN PATENT DOCUMENTS

JP 06081057 A * 3/1994

* cited by examiner

MATERIAL FOR ELECTRODES OF LOW TEMPERATURE PLASMA GENERATORS

The United States Government has rights in this invention pursuant to Contract No. W-7405-ENG-48 between the United States Department of Energy and the University of California for the operation of Lawrence Livermore National Laboratory.

RELATED APPLICATION

This application relates to Russian Patent Application No. 2000129858 filed Nov. 30, 2000.

BACKGROUND OF THE INVENTION

The present invention relates to the field of plasma engineering, particularly to electrodes for low temperature AC (alternating current and voltage) plasma generators, and more particularly the materials for fabricating such electrodes which have heat conduction, electric conductance, structural strength and electron emitting characteristics.

In the field of plasma engineering, substantial effort has been directed to manufacturing of electrodes for low temperature plasma generators providing emission of electrons and stable arc burning, i.e., AC plasma electrodes. Such electrodes have typically been made from copper and chromium carbide, although other materials and methods for production have been proposed.

In general, materials for electrodes (not AC plasma electrodes) containing barium and/or barium oxide as a component emitting electrons was proposed in U.S. Pat. No. 5,126,622 issued Jun. 30, 1992 to J. Jeong et al. Emitter of electrons is enclosed in porous metal material which has a lot of diffusion cavities. European Patent Application No. 0537495 published Apr. 21, 1993 proposes to mix dry metal powders with high melting point, high heat resistance and substances emitting electrons for manufacturing electrodes. The mixture is compacted in the sealed reaction vessel and is subjected to hot isostalic compacting to obtain a semifinished item which is processed on the machine-tool to receive the electrode of the designed shape. Barium aluminate is the substance emitting electrons.

U.S. Pat. No. 5,128,584 issued Jul. 7, 1992 to J. Choi proposes an impregnated dispersion electrode containing a porous metal matrix impregnated with the material, emitting electrons on the basis of scandium or scandium tungstate. By this means the availability of an emitting additive and metal matrix, providing current supply and fixating emitting addition, are common for all mentioned above patents. The present invention is based on the same principle but other combinations of components are used as a base and an emitter.

SUMMARY OF THE INVENTION

Material of the electrodes of low temperature plasma generators containing porous metal matrix impregnated with the material emitting electrons differs from those listed above in that it uses a mixture of copper and iron powders as a porous metal matrix and a Group IIIB metal-containing component (such as $Y_2O_3$) is used as a material emitting electrons at the following proportion of the components, mass %:

| | |
|---|---|
| Iron | 3-30 |
| Group IIIB metal component | 0.05-1 |
| Copper | the remainder |

Copper provides high level of heat conduction and electric conductance, iron decreases intensity of copper evaporation in the process of plasma creation providing increased strength and lifetime, the Group IIIB metal-containing component such as $Y_2O_3$ provides decreasing of electronic work function and stability of arc burning. Previous electrodes used in AC plasma generators have contained only copper or chromium carbide. The composition of the electrode of the invention contributes to a substantial increase in the lifetime of the electrodes to at least 10 times that of chromium carbide electrodes and 20 times that of copper electrodes. (The lifetime of the AC plasma electrode is that time after which the electrode must be replaced in an AC generator due to sufficient corrosion to cause the essential cease of function of the electrode.)

In an exemplary embodiment, dry metal powders of (Cu+Fe) and $Y_2O_3$ are mixed in the manufacture of electrodes. The received mixture is compacted on air in the mold in such a manner that cross-section areas of the compacted item and finished item relate as 4:1-8:1. Then the mixture is baked in shielding-reducing medium (hydrogen, dissociated ammonia) in temperature range of 900-1050° C. during 20 min-4 hours. After that, it is subjected to forging in temperature range of 850-950° C. to obtain the rod which has allowance on diameter of 2-3 mm or extrusions. Then mechanical processing is carried out to obtain ultimate dimensions.

DETAILED DESCRIPTION OF THE INVENTION

Figure 1A:
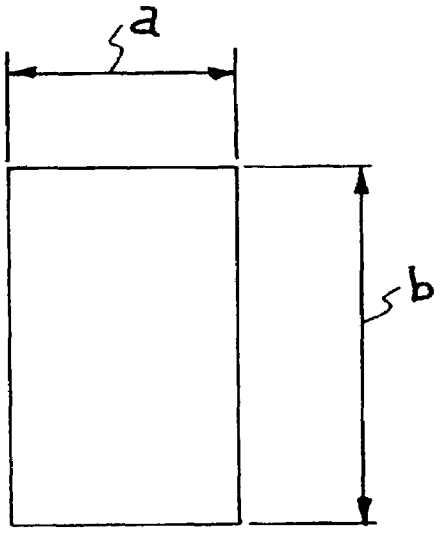
FIGS. 1A and 1B illustrate an embodiment of a blank of the electrode, with FIG. 1A being after compaction, and FIG. 1B being after forging.

Uniformity of distribution of introduced charge components by member volume is of great importance for stable operation of the plasma generator electrodes. In this connection particular emphasis should have been placed to the process of mixing of the initial components having different density and properties.

The electrode of the invention includes the combination of Iron (Fe) and Copper (Cu) together with electron emitting materials selected from one or more components containing Group IIIB metals of the Periodic Table. Such Group IIIB metal-containing components can include Scandium (Sc), Lanthanum (La), Actinium (Ac), and preferably Yttrium (Y). Although several Group IIIB metal-containing components may be employed, effective components include boron, tungsten and/or oxygen in combination with one or more Group IIIB metals. A highly useful composition contains Yttrium oxide ($Y_2O_3$), which hereinafter is described in several exemplary embodiments of the invention.

So that to create the composition containing 30% of Fe and 0.1% of $Y_2O_3$, the mixing was carried out in three steps sequentially:

1. Mixing of 10 g of Cu, 5 g of Fe and 5 g of $Y_2O_3$, total 20 g.

2. Add to the resulting composition 80 g of Fe, 200 g of Cu and mix once more.
3. Add to the resulting composition 1410 g of Fe and 3290 g of Cu (total 5000 g) and mix once more and then compaction and baking of blanks is performed from the resulting charge.

It was found experimentally in creation of the invention that optimum compaction pressure is 300-400 MPa (3-4 t/cm$^2$). Pressure increases above 400 MPa (3-4 t/cm$^2$) results in appearance of bulging and cracks on the surface of baking blanks because of the evaporation of adsorbed films inside the blanks.

Baking in reducing medium (hydrogen, dissociated ammonia) protects porous material from internal oxidation. It was experimentally found that temperature range of baking is 900-1050° C., baking time is from 20 minutes till 4 hours. For typical cases, baking temperature is 1000° C., baking time is 2 hours.

After compaction and baking, the blanks with dimensions indicated by arrows a and b of, for example, 60×90 mm were produced, as seen in FIG. 1A, and when they arrived for forging.

Forging pursues two goals:

production of the blank of the required dimension, strength increasing, elimination of the residual porosity and improvement of the operating characteristics of the material.

Due to two following circumstances, it is difficult to forge copper: Presence of <<brittleness zone>> of copper base in temperature range of 300-600° C.; presence of significant amount of brittle addition—yttrium oxide.

Figure 1B:
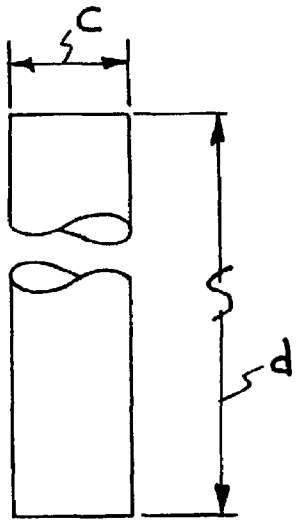

In the case being considered, the temperature range of forging was chosen in temperature range of 900-950° C. with time of exposure of 60 minutes at forging temperature. Forging was conducted in swages after 5 mm in a pass to the diameter with intermediate heating after each pass according to the scheme:

Ø60→Ø55→Ø45→Ø40→Ø35→Ø29 mm as shown by arrow d in FIG. 1B, with the length going from 90 mm to 280 mm, as seen by arrow d in FIG. 1B.

Samples for determination of mechanical properties were made along with the blanks for electrodes. The main mechanical properties are represented in Table 1.

TABLE 1

| Basic characteristic of the material | | Composition number 1 | 2 | 3 | 4 | 5 | 6 |
|---|---|---|---|---|---|---|---|
| Chemical composition | Fe | 3 | 10 | 30 | 30 | 30 | 30 |
| | $Y_2O_3$ | 0.1 | 0.1 | 0.1 | 0.25 | 0.5 | 1.0 |
| | Cu | Base | Base | Base | Base | Base | Base |
| Mechanical properties | Ultimate strength to the break, N/mm$^2$ | 200-210 | 225-235 | 255-280 | 180-190 | 175-185 | 125-135 |
| | Yield strength, N/mm$^2$ | 50-60 | 85-100 | 145-150 | 100-105 | 95-105 | 85-90 |

From represented data, it transpires that insertion of iron tends to increase the strength. Insertion of $Y_2O_3$ decreases the strength. Presence of 1% mass $Y_2O_3$ and more essentially hampers plastic deformation and further processing of the blanks.

The range of component content is chosen from the following considerations. Increase of $Y_2O_3$ content above than 1% decreases material plasticity and it is impossible to obtain the members of required shape and dimensions. Decrease of the Group IIIB metal component (such as $Y_2O_3$) content below about 0.1%, and in some cases below about 0.05%, is detrimental to arc stability, and decrease of Fe below 3%, greatly reduces strength. Increase of Fe content above 30% impermissibly decreases heat conduction and electric conduction.

Figure 2:
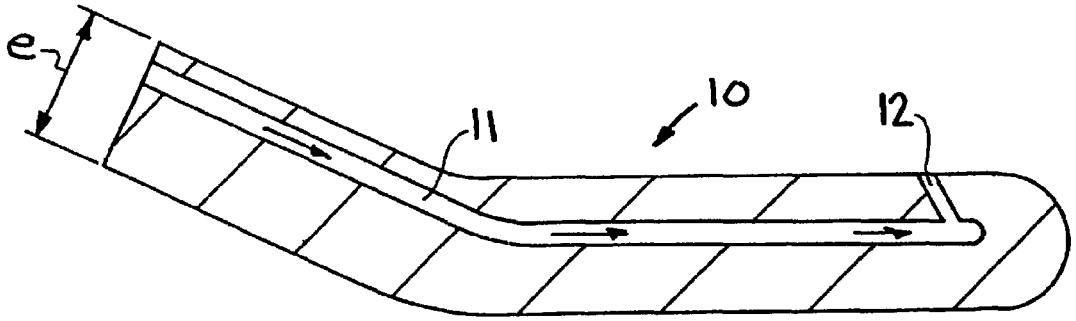
FIG. 2 is a cross-sectional view of an embodiment of a finished electrode made in accordance with the invention.

Mechanical processing and bending of blanks were carried out to obtain finished member, see FIG. 2, and operating characteristics of the material of the low temperature plasma generator were determined.

The finished electrode, indicated at 10, of FIG. 2, has, for example, a length of 260 mm and cross-section as indicated by arrow e of 25 mm, with a water cooling channel 11, 12 formed therein through which water flows as indicated by the flow arrows.

It has thus been shown that the present invention provides a material for electrodes of low temperature AC plasma generators. This material for low temperature AC plasma generators contains a porous metal matrix impregnated with the material emitting electrons and uses a baked mixture of copper and iron powders as a porous metal matrix and Group IIIB metal component (yttrium oxide $Y_2O_3$) inserted in the process of mixing of matrix powders as a material emitting electrons at the following proportion of the components, mass %:

| | |
|---|---|
| Iron | 3-30 |
| $Y_2O_3$ | 0.05-1 |
| Copper | the rest |

In another example, three AC plasma electrodes containing (1) copper, (2) chromium carbide and (3) the above 30% Cu, 0.1% $Y_2O_3$, remainder Fe composition of the invention, were manufactured and operated in two types of AC plasma generators, a single phase 10 kW generator and a 50 kW three phase plasma generator. The results of testing are indicated below:

TABLE 2

| Electrode Composition | 10 kW generator lifetime | 50 kW generator lifetime |
|---|---|---|
| copper | 10 hrs | 3 hrs |
| chromium carbide | 30 hrs | 10 hrs |
| copper/$Y_2O_3$/iron (new material) | 200 hrs | >100 hrs |

The data in Table 2 indicates that Group IIIB metal components in combination with iron and copper, provide enhanced lifetimes to AC plasma electrode compositions employed in an AC plasma generator.

While a particular embodiment, including specific materials and parameters has been described and illustrated to exemplify and teach the principles of the invention, such is not intended to be limiting. Modifications and changes may become apparent to those skilled in the art, and it is intended that the invention be limited only by the scope of the appended claims.

The invention claimed is:

1. In a low temperature plasma generator having at least one AC plasma electrode, the improvement comprising:

said electrode being constructed of a material comprising a porous metal matrix containing a baked mixture of copper and 3-30 mass percentage of iron metal powders, and 0.05-1 mass percentage of at least one Group IIIB metal component for emitting electrons.

2. The improvement of claim 1 wherein said Group IIIB metal component comprises $Y_2O_3$.

3. The improvement of claim 1, wherein said porous metal matrix consists essentially of copper and iron metal powders.

4. The improvement of claim 1, wherein said powders have a compaction of 300 to 400 MPa.

5. The improvement of claim 1, wherein said porous metal matrix contains a first component which provides a high level of heat conduction and electric conductance, and a second component which decreases intensity of evaporation of the first component in the process of plasma creation.

6. The improvement of claim 5, wherein said first component is copper, and said second component is iron.

7. The improvement of claim 1, wherein said electrode includes at least one cooling channel.

8. The improvement of claim 1, wherein the copper is present in component proportions of mass percentage of greater than 15%.

9. The improvement of claim 1, wherein the copper is present in component proportions of mass percentage of greater than 20%.

10. In a low temperature plasma generator having at least one AC plasma electrode, the improvement comprising:

said electrode being constructed of a material comprising a porous metal matrix containing a baked mixture of copper and 3-30 mass percentage of iron metal powders, and 0.05-1 mass percentage of at least one Group IIIB metal component for emitting electrons, wherein said Group IIIB metal component comprises $Y_2O_3$, wherein the iron, copper and Group IIIB metals are in component proportions of mass percentage of iron: 3-30, $Y_2O_3$:0.1-1, and copper: the remainder.

11. An AC plasma electrode comprising:

a baked mixture of:

a first copper metal powder component having a high level of heat conduction and electric conductance, a mass percentage of 3-30 of a second iron metal powder component which decreases intensity of the first component evaporation in the process of plasma creation, and a mass percentage of 0.05 to 1 of a third powder component containing one or more Group IIIB metals for emitting electrons and provides decreasing of electronic work function and stability of arc burning.

12. The electrode of claim 11, wherein said third powder component comprises a Group IIIB metal component selected from the group consisting of Scandium, Lanthanum, Actinium and Yttrium.

13. The electrode of claim 11 comprises a mixture of dry powders of said first, second, and third components having a compaction of 300 to 400 MPa.

14. The electrode of claim 11, wherein said third powder component comprises $Y_2O_3$ powder.

15. The electrode of claim 11, wherein said metal powders of Cu+Fe form a porous metal matrix which is impregnated with electron emitting powders of a Group IIIB metal component.

16. The improvement of claim 11, wherein the copper is present in component proportions of mass percentage of greater than 15%.

17. An AC plasma electrode comprising:

a baked mixture of:

a first copper metal powder component having a high level of heat conduction and electric conductance, a mass percentage of 3-30 of a second iron metal powder component which decreases intensity of the first component evaporation in the process of plasma creation, and a mass percentage of 0.05 to 1 of a third powder component containing one or more Group IIIB metals for emitting electrons and provides decreasing of electronic work function and stability of arc burning, wherein said third powder component comprises a Group IIIB metal component selected from the group consisting of Scandium, Lanthanum, Actinium and Yttrium, wherein said components are in a mass percentage of iron: 3-30, $Y_2O_3$: 0.05-1, and copper: the rest.

18. An AC plasma electrode comprising:

a baked mixture of:

a first copper metal powder component having a high level of heat conduction and electric conductance, a mass percentage of 3-30 of a second iron metal powder component which decreases intensity of the first component evaporation in the process of plasma creation, and a mass percentage of 0.05 to 1 of a third powder component containing one or more Group IIIB metals for emitting electrons and provides decreasing of electronic work function and stability of arc burning, wherein said third powder component comprises $Y_2O_3$ powder, wherein said Cu, Fe and $Y_2O_3$ powders are mixed in a mass % of Fe:3-30, $Y_2O_3$:0.1-1, and Cu: the remainder.

* * * * *